US006968809B2

(12) United States Patent
Reardon

(10) Patent No.: US 6,968,809 B2
(45) Date of Patent: Nov. 29, 2005

(54) CHILD HARNESS WITH HANDLE

(76) Inventor: Richard Reardon, 1112 58th St., Kenosha, WI (US) 53140

( * ) Notice: Subject to any disclaimer, the term of this patent is extended or adjusted under 35 U.S.C. 154(b) by 0 days.

(21) Appl. No.: 10/690,790

(22) Filed: Oct. 22, 2003

(65) Prior Publication Data

US 2005/0087146 A1 Apr. 28, 2005

(51) Int. Cl.[7] ..... A62B 35/00; B60R 22/00
(52) U.S. Cl. ..... 119/770; 2/310
(58) Field of Search ..... 119/769, 770, 771, 119/907; 2/310, 311, 312

(56) References Cited

U.S. PATENT DOCUMENTS

| | | | | | |
|---|---|---|---|---|---|
| 721,305 | A * | 2/1903 | Hunkins | 2/310 |
| 1,193,374 | A * | 8/1916 | Gilliam | 482/69 |
| 2,212,746 | A * | 8/1940 | Nunn | 119/770 |
| 3,142,844 | A * | 8/1964 | Murray | 2/310 |
| 5,119,767 | A * | 6/1992 | Jimenez | 119/770 |
| 5,120,287 | A * | 6/1992 | Brown et al. | 119/770 |
| 5,388,551 | A * | 2/1995 | Martusciello | 119/770 |
| 5,435,272 | A * | 7/1995 | Epstein | 119/770 |
| 5,692,456 | A * | 12/1997 | Louks-Phillips | 119/770 |
| 6,125,792 | A * | 10/2000 | Gee | 119/770 |
| 6,317,050 | B1 * | 11/2001 | Burks | 340/573.6 |
| 6,338,699 | B1 * | 1/2002 | Veitch | 119/770 |
| 6,467,851 | B1 * | 10/2002 | Mannell et al. | 119/770 |
| 6,626,131 | B2 * | 9/2003 | Moulton, III | 119/770 |
| 2004/0065272 | A1 * | 4/2004 | Reynolds et al. | 119/770 |
| 2004/0112302 | A1 * | 6/2004 | Guynn | 119/770 |

* cited by examiner

*Primary Examiner*—Teri Pham Luu
*Assistant Examiner*—Elizabeth Shaw
(74) *Attorney, Agent, or Firm*—Jansson, Shupe, Munger & Antaramian, Ltd.

(57) ABSTRACT

A harness for a child is disclosed. The harness comprises an upper torso support component having front and rear portions, a lower torso support component having front and rear portions, and at least one handle extending between the rear portions of the upper and lower torso support components allowing the child to be lifted and supported by the harness. The lower torso support component may include a support belt for encircling the child's waist and a crotch support member extending from the front portion of the support belt to the rear portion of the support belt. In certain embodiments, the handle is connected to the front and rear portions at mounts spaced apart by a flex length which is less than the handle length such that the handle flexes to provide a handle void to facilitate grasping the handle.

16 Claims, 4 Drawing Sheets

CHILD HARNESS WITH HANDLE

FIELD OF INVENTION

The present invention relates to child harness and, in particular, to child harnesses which provide handles for lifting and holding a child.

BACKGROUND OF THE INVENTION

Young children, particularly toddlers, often must be stopped, lifted, held or carried for their own safety. Such handling of children can lead to injury, particularly when a child is in imminent danger. For instance, when a child is wandering onto a roadway or near a stairway or other dangerous area the child is typically quickly grasped away from such danger by the hand or arm which can lead to serious injury. In addition, the child may slip away from such a grasp and encounter the danger despite the adult's effort to restrain the child.

Even when not in danger, safely lifting a child generally requires that an adult use both hands and bend down to the child. This movement can be stressful especially when repeated frequently. In addition, the stress involved can be aggravated when dealing with a child who does not want to be lifted.

Likewise, carrying a child typically requires that an adult support the child with at least one arm while the child clings to the adult. For uncooperative children, the adult may need to use both arms for support. Often, the adult needs to use his arms to carry other articles, especially those used for the child such as car seats, strollers, bedding, extra clothing, diapers, food, etc. Such a need is particularly felt when traveling.

Therefore, there is a continuing significant need in the field of child care for improvements in child handing. More particularly, there is a need for facilitation of restraining, lifting and holding a child.

Furthermore, there is a need in the field of child care for a device which allows restraining, lifting and holding a child with one hand.

In addition, there is a need for such a device which comfortably supports a child while providing adequate control of the child.

There is also a need for such a device which can be worn by a child without injuring or bothering the child.

Such a device would be an important improvement in the field of child care.

OBJECTS OF THE INVENTION

It is an object of the invention to provide a harness for a child which overcomes noted problems in the prior art.

Another object of the invention is to provide a harness which facilitates handling of a child and which can be comfortably worn by a child.

Another object of the invention is to provide a harness which includes a semi-rigid handle which can be comfortably worn by the child.

Another object of the invention is to provide a harness which includes a semi-rigid handle which can be clasped in a position to facilitate grasping of the handle by an adult.

Another object of the invention is to provide a harness which includes a semi-rigid handle which can be fastened down in a position so that the handle does not inadvertently "catch" on anything.

Another object of the invention is to provide a harness which includes a semi-rigid handle which flattens when the child lies on the handle.

Still another object of the invention is to provide a harness which allows handling of the child even if the harness is disconnected.

These and other objects of the invention will be apparent from the following descriptions and from the drawings.

BRIEF SUMMARY OF THE INVENTION

In accordance with the present invention, harness for a child is provided for allowing the child to be lifted and held. The harness of this invention overcomes certain problems and shortcomings of the prior art, including those noted above, and provides a unique structure satisfying a number of specific needs.

In certain embodiments, the harness comprises a support belt for encircling the child's waist and having a front portion and a rear portion, a crotch support member extending from the front portion to the rear portion, an upper torso support component extending from the front portion to the rear portion, and a handle connecting the support belt and the torso support component which allows the child to be lifted and supported by the harness.

The support belt may include first and second ends which are connected together at the rear portion to allow the support belt to be fastened around the child's waist. In such embodiments, the crotch support member may include a bifurcated end having a first and second tail with the first tail connected to the support belt near the first end and the second tail connected to the support belt near the second end. In these harnesses, the upper torso support component may include left and right straps with the left strap connecting to the front portion of the support belt, extending over the child's left shoulder and connecting to the rear portion of the support belt, and the right strap connecting to the front portion of the support belt, extending over the child's right shoulder and connecting to the rear portion of the support belt. The left and right straps may each include a releasable connection between the child's shoulder and the support belt. The left and right straps may further be connected to one another by a chest strap which extends across the child's chest when worn.

In certain embodiments, two handles connect the support belt and the upper torso support component. Such handles include a left handle connecting the support belt and the left strap and a right handle connecting the support belt and the right strap. In such harnesses, a clasp may be mounted to one of the handles to allow connection of the handles to one another. In some embodiments, the handles are semi-rigid such that each handle extends out from the child's back when clasped together to facilitate grasping of the handles. The harness may further include a fastener or fasteners for securing the handles against the upper torso support component to make the handles lie flat against the child's back when secured by the fasteners.

In some embodiments, the harness provides sufficient support to the child to allow lifting and holding the child aloft even when the first and second ends of the support belt are disconnected and the left and right straps are disconnected between the child's shoulder and the support belt.

In some embodiments, the harness for a child comprises an upper torso support component having front and rear portions, a lower torso support component having front and rear portions, and two semi-rigid handles extending between the rear portions of the upper and lower torso support components. In such an embodiment, each handle has top and bottom ends and a handle length, with the top and bottom ends being connected to the front and rear portions at mounts spaced apart by a flex length with the flex length being less than the handle length such that the handles flex to provide handle voids to facilitate grasping the handles.

In certain embodiments, one of the handles may include a clasp for connecting the handles such that the handles flex out from the child's back when clasped together. When flexed out from the child's back, the handles form a handle void to facilitate grasping the handles to stop, hold or lift the child. The harness may further include fasteners for securing the handles against the upper torso support component. When secured by the fasteners, the handles lie flat against the child's back. When neither secured by the fasteners or clasped together, the handles are substantially free to move but generally lie between the fastened and clasped positions. The handles easily move or collapse when contacted; for instance, when placing a child on his back the handles collapse and do not prod the child's back. As such, the handles' semi-rigidity allows for comfort to the child while facilitating grasping when clasped together.

In certain embodiments, the upper torso support component includes left and right straps and the lower torso support component includes a support belt and a crotch support member. In such embodiments, the crotch support member and the left and right straps extend from a front portion of the support belt to a rear portion of the support belt. Specifically, the left strap extends from the front portion of the support belt over the child's left shoulder to the rear portion of the support belt and the right strap extends from the front portion of the support belt over the child's right shoulder to the rear portion of the support belt, each strap including a coupling between the child's shoulder and the rear portion of the support belt. Such couplings allow the straps to be disconnected to allow the child to be placed in or removed from the harness.

The harness may be designed to provide sufficient support to the child to allow lifting and holding the child aloft even when the first and second ends of the support belt are disconnected and the left and right straps are disconnected between the child's shoulder and the support belt.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment. In the drawings.

DETAILED DESCRIPTION OF PREFERRED EMBODIMENTS

Figure 1:
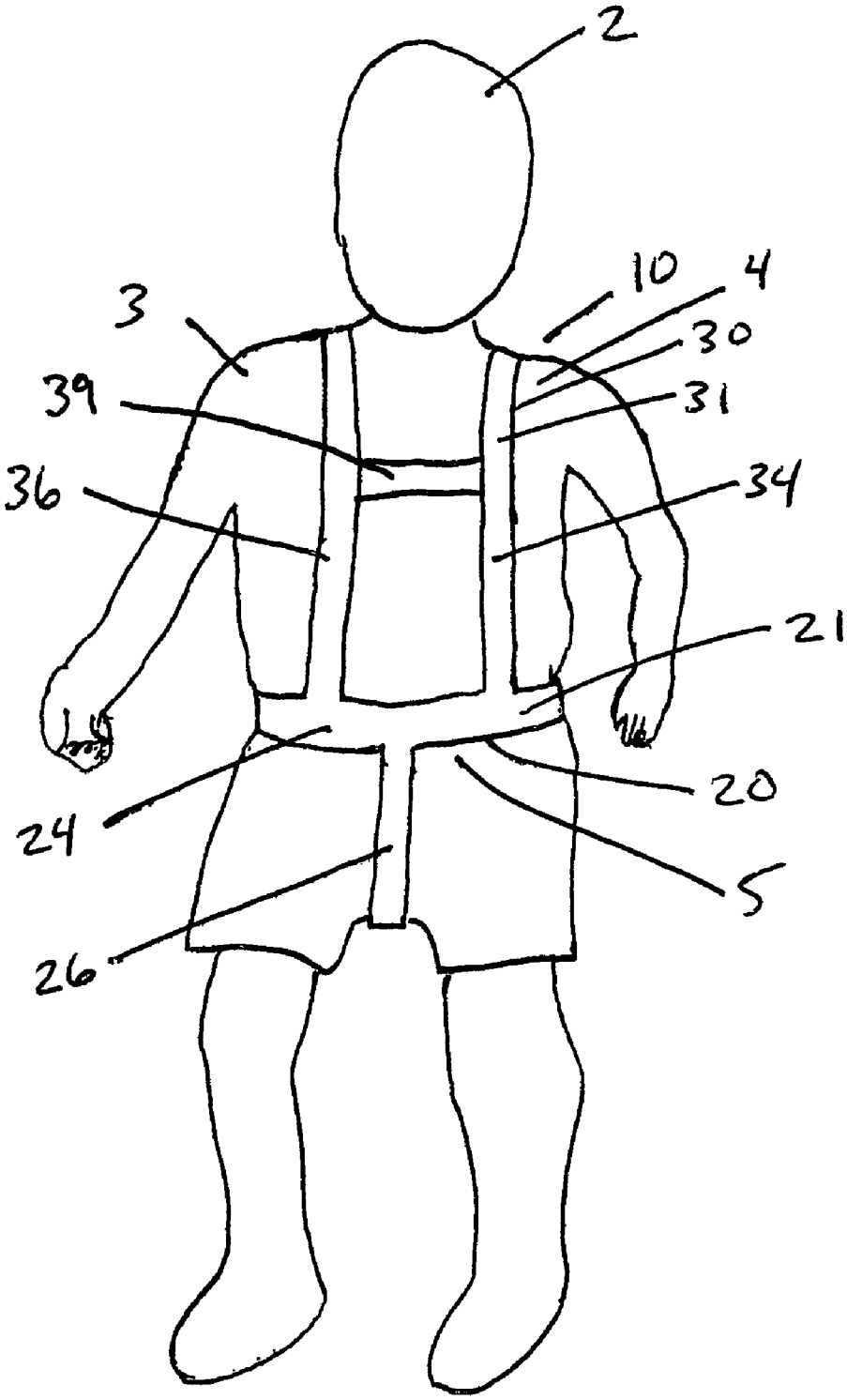
FIG. 1 is a perspective view of the front of a child wearing the harness in accordance with the invention.

Referring to FIG. 1, a harness in accordance with the present invention is generally designated by the reference numeral 10. Harness 10, worn by child 2, includes a lower torso support component 20 and an upper torso support component 30. Lower torso support component 20 includes a support belt 24 which encircles the child's waist 5 and a crotch support member 26. Lower torso support component 20 has a front portion 21 and rear portion (22, not shown) with crotch support member 26 extending therebetween.

Upper torso support component 30 includes a front portion 31 and rear portion (32, not shown). A left strap 34 extends from lower torso support component 20 over the child's left shoulder 4 to rear portion 32 and a right strap 36 extends from lower torso support component 20 over the child's right shoulder 3 to rear portion 32. Left and right straps 34,36 are connected in front portion 31 by a chest strap 39 which extends across the child's chest.

Figure 2:
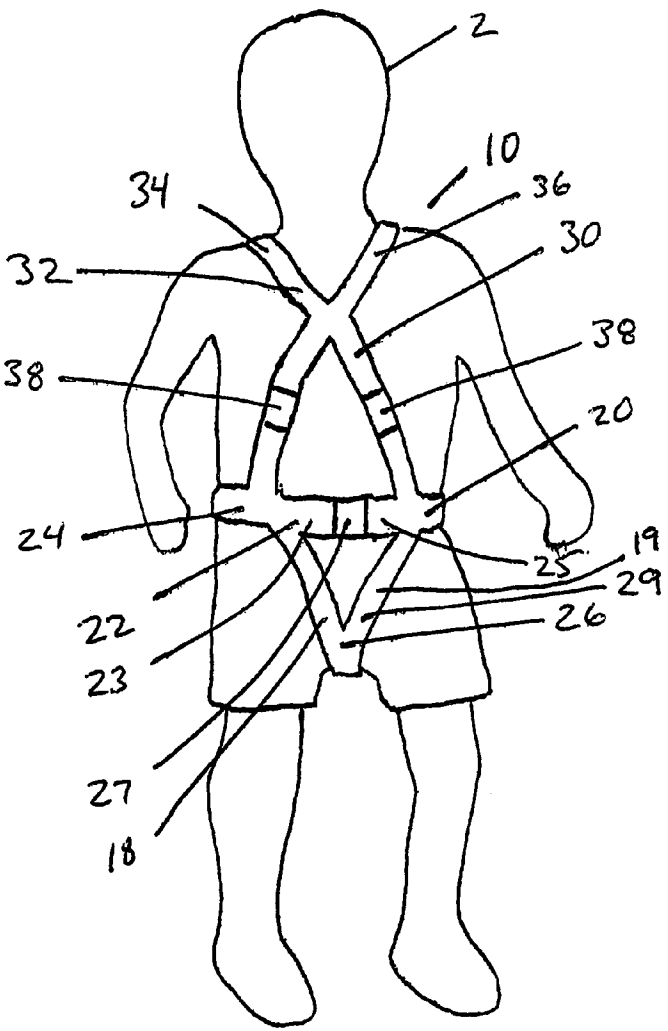
FIG. 2 is a perspective view of the back of a child wearing the upper and lower torso support components in accordance with the invention.

FIG. 2 shows the rear portions 22,32 of lower and upper torso support components 20,30 worn by child 2. As shown, left and right straps 34,36 cross over before extending downwardly to rear portion 22 of lower torso support 20. Each strap 34,36 includes a coupling 38 which provides for connection and disconnection of each strap 34,36 to allow for a child to get in and out of harness 10. Coupling 38 may be similar to known couplings which include a female and male fitting and which require pressure along a flange of the male fitting to allow for release of the male fitting from the female fitting. Of course other connection arrangements can be utilized, though it is preferable that the connection arrangement be simple for an adult to use and difficult for the child to disconnect. Couplings 38 are preferably arranged opposite from one another so that straps 34,36 are not improperly attached to lower torso support 20. For instance, coupling 38 on left strap 34 may have an upper male fitting and a lower female fitting while coupling 38 on right strap 36 may have an upper female fitting and a lower male fitting. Such an arrangement prevents a child from being put into harness 10 incorrectly.

As shown, support belt 24 includes a first end 23 and second end 25 which are connected by buckle 27. Buckle 27 may be of similar design to couplings 38, but preferably does not include fittings which will connect to the fittings of couplings 38. For instance, buckle 27 may be of a different size or design such that connection between buckle 27 and either coupling 38 is impossible. Crotch support member 26 is shown as having a bifurcated end 29 which includes a first tail 18 and second tail 19. First tail 18 connects to first end 23 of support belt 24 and second tail 19 connects to second end 25 of support belt 24.

Figure 3:
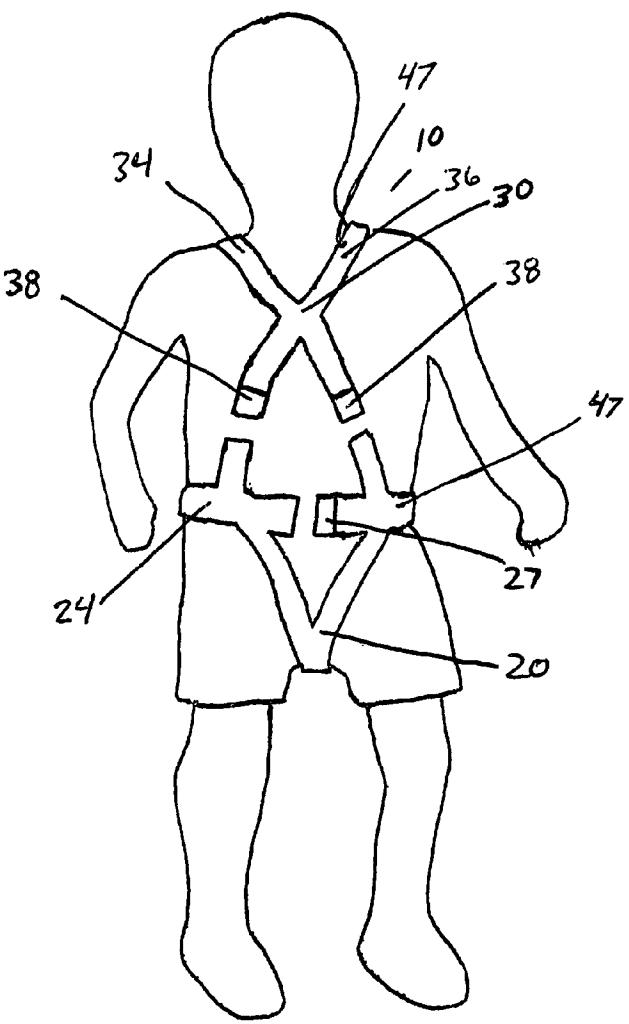
FIG. 3 is a perspective view of the back of a child wearing the upper and lower torso support components with the upper and lower torso support components disconnected in accordance with the invention.

FIG. 3 shows the rear portions 22,32 of lower and upper torso support components 20,30 worn by child 2 and disconnected. As can be seen, left and right straps 34,36 and support belt 24 are disconnected at couplings 38 and buckle 27. Left and right straps 34,36 and support belt 24 may be disconnected to allow the child to be removed from harness 10, for comfort or for other reasons. Nevertheless, due to the design of harness 10, a handle (not shown) mounted between mount 47 on right strap 36 and mount 47 on support belt 24, and a handle similarly mounted on the child's left side, can effectively support the child since such disconnections do not occur along any position of tension when the child is supported. This concept can be more clearly seen in the following figures dealing with the handle 40.

Figure 4:
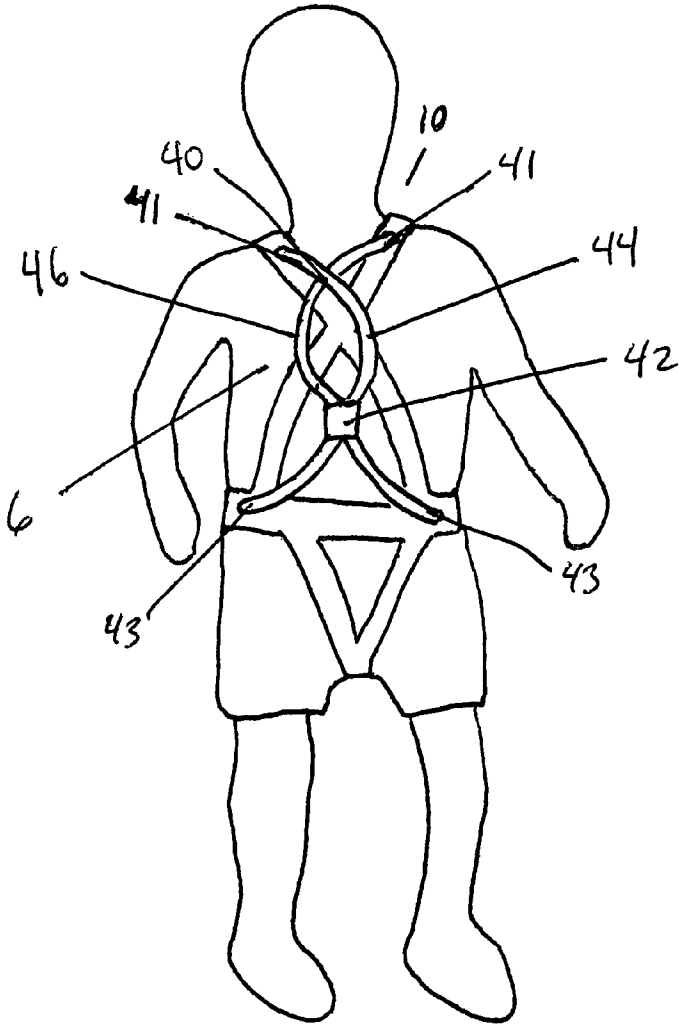
FIG. 4 is a perspective view of the back of a child wearing the harness with the handles clasped together in accordance with the invention.

FIG. 4 shows handle 40, comprising left handle 44 and right handle 46, in a position for grasping by an adult. Left and right handles 44,46 are clasped together by clasp 42 such that handles 44,46 extend outward (toward the viewer) from the child's back 6 to define a handle void. Each handle 44,46 extends between a top end 41 and a bottom end 43 for a linear length, herein defined as a handle length. However, each handle 44,46 is mounted to harness 10 at mounts 47 which are separated by a length, herein defined as a flex length, which is shorter than the handle length. Therefore, each handle 44,46, being semi-rigid, is forced to flex into an arcuate shape. Clasp 42, when connecting handles 44,46, ensures that such arcuate shapes are aligned to form a handle void which allows an adult to grasp both handles 44,46 and lift or restrain the child. Clasp 42 may form a loop through which each handle passes. In such embodiments clasp 42 has two ends which are fixed to one another after handles 44,46 are placed alongside clasp 42, thereby securing handles 44,46 within clasp 42.

Figure 5:
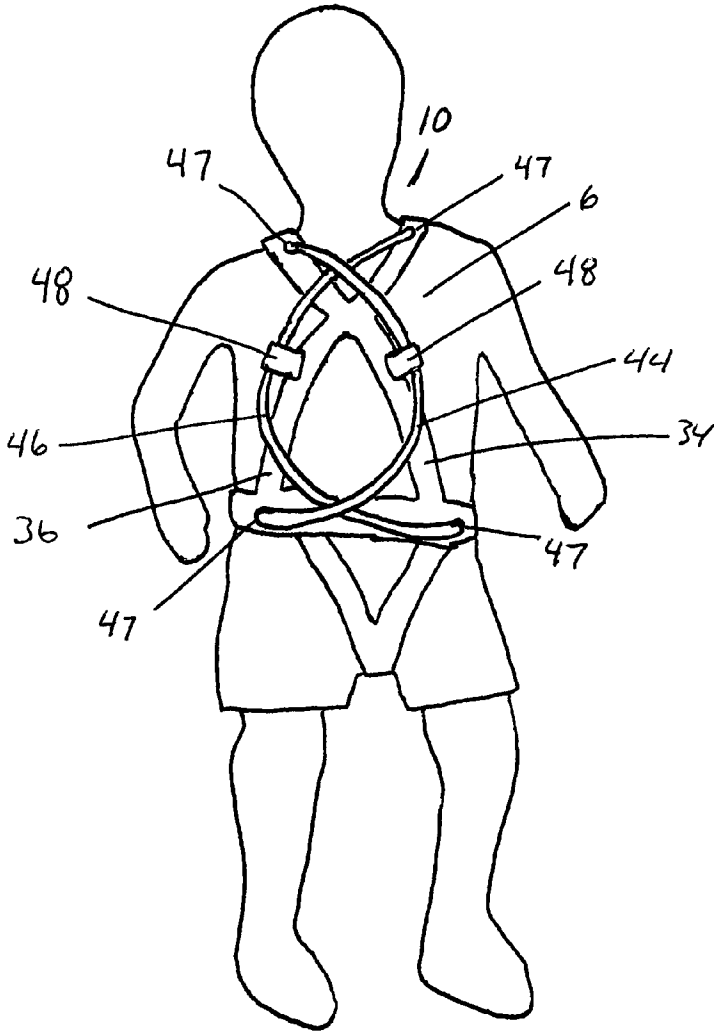
FIG. 5 is a perspective view of the back of a child wearing the harness with the handles fastened down in accordance with the invention.

FIG. 5 shows harness 10 with handles 44,46 fastened down. Fasteners 48 are fixed to left and right straps 34,36 and allow handles 44,46 to be secured to upper torso support component 30. Fasteners 48 may be similar to clasp 42 and form a loop through which a handle 44,46 passes.

Figure 6:
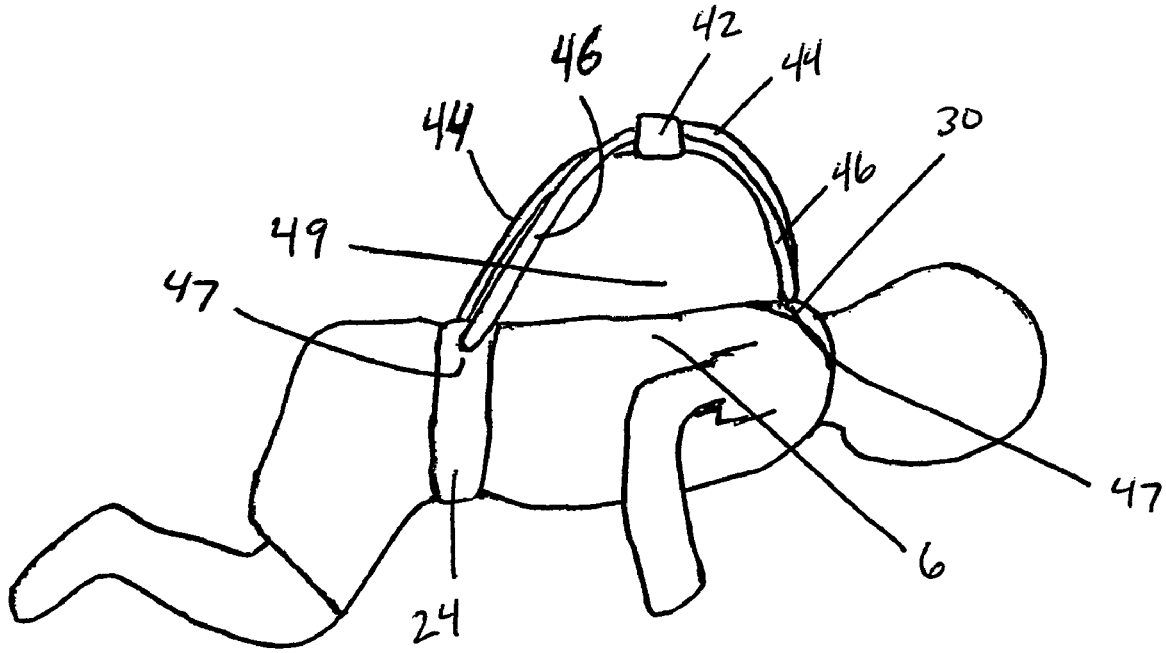
FIG. 6 is a perspective view of a side of a child wearing the harness with the handles clasped together in accordance with the invention.

FIG. 6 is a side view of a child wearing harness 10. As shown, clasp 42 connects handles 44,46 and holds them away from the child's back 6, forming handle void 49. The connection of right handle 46 at mounts 47 on support belt 24 and upper torso support component 30 shows how the connection of couplings 38 and buckle 27 is unnecessary for supporting the child since handles 44,46 connect with lower and upper torso support components 20,30 at positions beyond those connections, i.e., none of the disconnections occur along any position of tension when the child is supported since all tension is in the front portions 21,31 of the lower and upper torso support components 20,30 and the handles 44,46.

Figure 7:
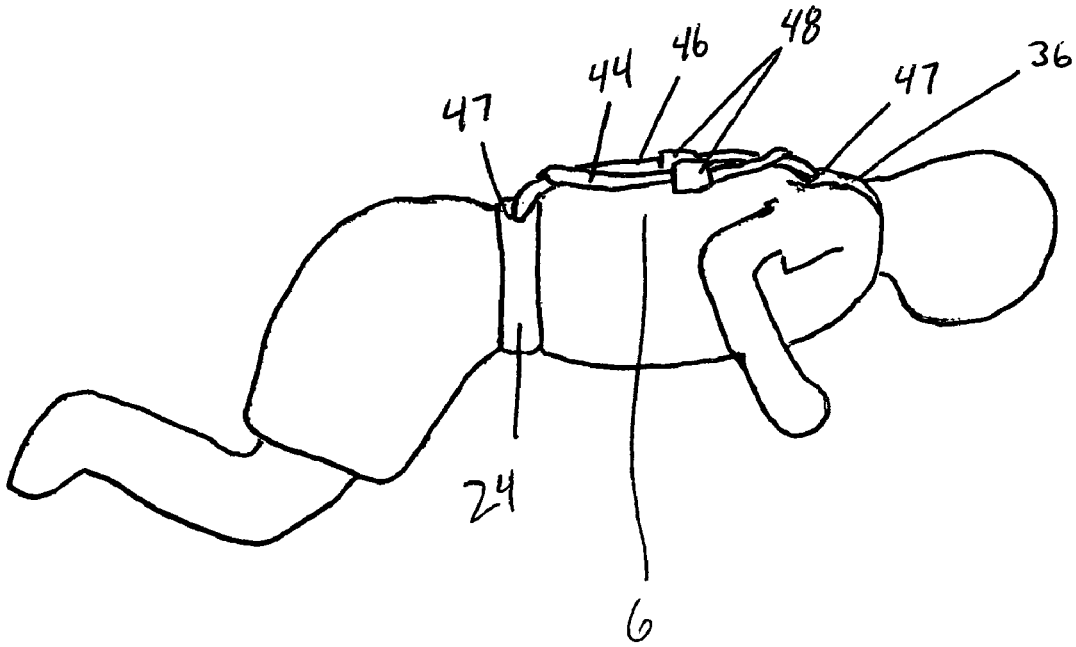
FIG. 7 is a perspective view of the side of a child wearing the harness with the handles fastened down in accordance with the invention.

FIG. 7 is another side view of a child wearing harness 10. As shown, fasteners 48 hold handles 44,46 down, along the plane generally defined by the child's back 6. Again, right handle 46 is shown connected at mounts 47 to support belt 24 and right strap 36. Left handle 44 is shown crossing over right handle 46 and passing through fastener 48 on the near side of the child.

As discussed earlier, handles 44,46 are semi-rigid and may bend or otherwise shift when not secured by clasp 42 or fasteners 48. Therefore, child 2 may roll on his back or lean against walls or other surfaces without being hurt by handles 44,46. Likewise, couplings 38 and buckle 27 may have a thin profile such that the child is not injured or bothered by pressure on these components. All other harness components are preferably formed of fabric, leather or other soft and non-rigid materials such that the child is comfortable when wearing the harness 10. These components may be sewn, adhered, or otherwise safely connected together such that the harness 10 withstands the normal tensions involved in restraining, lifting or holding a child.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A harness for a child, the harness comprising an upper torso support component having front and rear portions, a lower torso support component having front and rear portions, and two semi-rigid handles extending between the rear portions of the upper and lower torso support components, each handle having top and bottom ends and a handle length, the top and bottom ends being connected to the rear portions at mounts spaced apart by a flex length, the flex length being less than the handle length such that the handles flex to provide handle voids to facilitate grasping the handles.

2. The harness of claim 1 wherein one of the handles includes a clasp for connecting the handles, the handles flexing out from the child's back when clasped together.

3. The harness of claim 2 further comprising fasteners for securing the handles against the upper torso support component, the handles lying flat against the child's back when secured by the fasteners.

4. The harness of claim 1 wherein the upper torso support component includes left and right straps and the lower torso support component includes a support belt and a crotch support member, the crotch support member and the left and right straps extending from a front portion of the support belt to a rear portion of the support belt.

5. The harness of claim 4 wherein the left strap extends from the front portion of the support belt over the child's left shoulder to the rear portion of the support belt and the right strap extends from the front portion of the support belt over the child's right shoulder to the rear portion of the support belt, each strap including a coupling between the child's shoulder and the rear portion of the support belt.

6. The harness of claim 5 wherein the support belt includes first and second ends, the first and second ends being connected at the rear portion.

7. The harness of claim 6 wherein the harness provides sufficient support to the child to allow lifting and holding the child aloft even when the first and second ends of the support belt are disconnected and the left and right straps are disconnected between the child's shoulder and the support belt.

8. The harness of claim 7 wherein the left and right straps each include a releasable connection between the child's shoulder and the support belt.

9. The harness of claim 8 wherein the left and right straps are connected together by a chest strap.

10. The harness of claim 8 wherein two handles connect the support belt and the upper torso support component, the two handles including a left handle connecting the support belt and the left strap and a right handle connecting the support belt and the right strap.

11. The harness of claim 10 further comprising a clasp mounted to one of the left and right handles, the clasp allowing connection of the left and right handles.

12. The harness of claim 11 wherein the left and right handles are semi-rigid such that each handle extends out from the child's back when clasped together to facilitate grasping of the handles.

13. The harness of claim 12 further comprising fasteners for securing the handles against the upper torso support component, the handles lying flat against the child's back when secured by the fasteners.

14. The harness of claim 13 wherein the harness provides sufficient support to the child to allow lifting and holding the child aloft even when the first and second ends of the support belt are disconnected and the left and right straps are disconnected between the child's shoulder and the support belt.

15. A harness for a child comprising:

a support belt for encircling the child's waist, the support belt having a front portion and a rear portion;

a crotch support member extending from the front portion to the rear portion;

an upper torso support component extending from the front portion to the rear portion; and a semi-rigid handle for allowing the child to be lifted and supported by the harness, the handle extending between the rear portions of the support belt and upper torso support component, the handle having top and bottom ends and a handle length, the top and bottom ends being connected to the rear portions at mounts spaced apart by a flex length, the flex length being less than the handle length such that the handles flex to provide handle voids to facilitate grasping the handle.

16. The harness of claim 15 wherein the support belt includes first and second ends, the ends being connected together to allow the support belt to be fastened around the child's waist, the first and second ends being connected together at the rear portion.

* * * * *